United States Patent [19]

Grimes et al.

[11] Patent Number: 4,993,140

[45] Date of Patent: Feb. 19, 1991

[54] METHOD OF MAKING TRANSFORMERS AND CORES FOR TRANSFORMERS

[75] Inventors: Frank H. Grimes; Eugenius S. Hammack, both of Athens, Ga.

[73] Assignee: ABB Power T & D Co., Inc., Blue Bell, Pa.

[21] Appl. No.: 466,144

[22] Filed: Jan. 16, 1990

Related U.S. Application Data

[62] Division of Ser. No. 293,162, Jan. 3, 1989, abandoned.

[51] Int. Cl.[5] ..... H01F 41/02

[52] U.S. Cl. ..... 29/606; 29/609; 336/217; 336/234

[58] Field of Search ..... 29/606, 609, 605; 336/212, 213, 216, 217, 234

[56] References Cited

U.S. PATENT DOCUMENTS 4,364,020 12/1982 Lin et al. ..... 336/212

4,734,975 4/1988 Ballard et al. ..... 29/606

*Primary Examiner*—Carl E. Hall

*Attorney, Agent, or Firm*—Hymen Diamond

[57] ABSTRACT

A method of making a transformer having a core composed of a web of magnetic amorphous metal of small thickness.

The laminations of the core of the transformer are the stacked turns formed by winding the web into a spiral having a window in the center. The coils are wound as integral structures having openings for telescoping the coils onto the core. For the telescoping, the core is cut and converted into a U-shaped structure on whose arms the coils are telescoped. The cut joint is a butt-lap-step joint. To produce such a joint, the laminations are divided into groups and each group is divided into steps which are spaced longitudinally of the web. After the coils are telescoped onto the core, the cut ends of the arms of the U are abutted to form a closed core. The cuts in the laminations that make up alternate groups in the stack are inclined to the longitudinal center line of the web at a first angle different from 90°. The cuts in the laminations that make up intervening groups in the stack are inclined oppositely to the cuts in the alternate groups at an angle which is also different from 90°. Because of the different inclination of successive cuts, the undesired abutting of laminations from different groups during the reclosing of the core is precluded. There is also disclosed a core and a transformer made by the method.

7 Claims, 8 Drawing Sheets

METHOD OF MAKING TRANSFORMERS AND CORES FOR TRANSFORMERS

REFERENCE TO RELATED APPLICATION

This application is a division of application Ser. No. 07/293,162 filed Jan. 3, 1989 now abandoned to Frank H. Grimes and Eugenius S. Hammack for TRANSFORMERS AND CORES FOR TRANSFORMERS and assigned to Westinghouse Electric Corporation.

BACKGROUND OF THE INVENTION

This invention relates to transformers, typically distribution transformers, and it has particular relationship to transformers whose cores are composed of laminations of amorphous metal of small thickness. Typically the thickness of the laminations is of the order of 0.001-inch. While this invention is disclosed herein in detail as applied to a transformer having a core of a wound amorphous metal web of small thickness, as to which this invention has unique advantages, it is understood that the adaptation of the principles of this invention to transformers of other types is within the scope of equivalents of this application and of any patent that may issue on or as a result thereof, typically as the range of equivalents is applied in Graver Tank & Mfg. Co. v. Linde Air Products Co. 339 U.S. 605; 70 Supreme Court Reporter 854 (1950) and interpreted in Uniroyal v. Rudkin-Wiley Corp. 5 USPQ 2d 1434 (CAFC 1988).

U.S. Pat. No. 4,709,471 to Milan D. Valencic and Dennis A. Schaffer, assigned to Westinghouse Electric Corporation discloses a method for making the cores of these transformers. U.S. Pat. No. 4,761,630 to Frank H. Grimes and Eugenius Hammack, also assigned to Westinghouse Electric Corporation, discloses structural features of these cores. Valencic teaches that a web of the amorphous metal is wound into a closed spiral core loop or core structure with a window in the center. The turns of the spiral form the laminations of the core. These laminations forming the closed core structure are then cut in successive stepped groups and the closed structure is opened and converted into a U-shaped structure on whose arms the coils of the transformers are telescoped. The arms of the U-shaped structure are then abutted to reconvert the U-shaped structure into a closed structure. Grimes discloses a core as taught by Valencic with lapped steps.

To explain this invention so that those skilled in the art will understand it, it is desirable to discuss Grimes briefly. FIGS. 3 and 4 of Grimes show highly enlarged a fragmentary part of the core as viewed in a direction perpendicular to the edges of the laminations. If FIG. 3 were extended to show the whole core, it would show the laminations in a race-track or circular annular shape. The structure shown is stepped with the steps lapped at their adjoining laminations. For this application, each unit of laminations A, B or C or D, E or F is defined as a step and the steps A, B and C together or D, E and F together are defined as a group. The laminations are typically only 0.001-inch in thickness so that the step F has a thickness of 0.007. The thickness of group DEF is 0.021-inch. Grimes says that there may be as many as thirty laminations in each step. In this case, each group would have a thickness of 0.09-inch. There may also be less than seven laminations in each step; in fact, there may be one lamination in each step.

While the teachings of Valencic and Grimes have made formidable contributions to the transformer art, a problem has been experienced in the construction of the core as taught by Valencic and Grimes. In the reconstitution of the core after the coils are telescoped on its arms, difficulty has been encountered in matching the separated ends of the laminations of the groups so that severed ends of laminations on one side of a group are joined during reassembly to the ends of the same laminations on the opposite side of a group. The small thickness of the groups is a major factor contributing to this problem. In past practice a group of laminations is at times erroneously matched with two opposing groups during reassembly. The error becomes apparent only on completion of the joint reassembled when a spare group of laminations with no matching companion groups remains. For example, with reference to FIG. 3 of Grimes, the twenty-one laminations on the right of group ABC instead of being joined to the laminations on the left of group ABC, are joined to the laminations on the left of group DEF. When this happens the core as completed has unconnected laminations and must be reprocessed. The deficiency is not discovered until after the core is completed. In addition, after the above-described error occurs, an opposing error may occur during the continued reassembly, i.e., the laminations on the right of a group such as DEF are joined to the laminations on the left of a group such as ABC. In this case, the errors are compensating and are not discovered after the core is completed and the core performance is deteriorated.

Another problem which arises in connection with cores in one of whose yokes or legs severable joints exist, has its roots in the principle that among the various factors that govern the power to excite a transformer is the local net transverse cross-sectional area reduction which results from the gaps in the core that form the joint. The net cross-sectional area is reduced and the required exciting power is increased by the gaps in the laminations at the joint. In cores formed of laminations of amorphous metal, this problem is particularly significant because, in use, such cores are operated at inductions very near to that which produces saturation. Appreciable reduction in the net transverse cross-sectional area of a core may result in saturation when the core is used. In a joint containing a large number of gaps, particularly if the gaps are stacked, there is a substantial reduction in net cross-sections area and a tendency for saturation to occur with corresponding adverse effect upon core losses.

Another problem which occurs when a butt-lap-step core joint as taught by Grimes is reassembled arises from the tendency of the laminations to adhere to each other such that more than one group of cut steps may be mismatched and mislocated against a single opposing group. This error is also only discovered after the joint is completely reassembled. The error occurs on the side of the joint where the longest laminations are on top viewing the joint being reassembled positioned horizontally. The shorter laminations of adjacent groups tend to adhere. The opposite side of the core where the longest laminations are at the bottom are "self separating" by groups.

It is an object of this invention to overcome the above-described drawbacks and deficiencies and to provide a method for accomplishing this purpose. Namely, it is an object of the invention to provide a method of making a transformer having a core of amorphous metal, formed by winding into a spiral a plurality of turns or laminations of small thickness, which core has a severable joint that is opened to permit the telescoping of coils and thereafter reclosed by abutting the ends of the severed laminations, in whose practice, the mismatching of abutted laminations during the reclosing shall be precluded.

It is also an object of this invention to provide a method of making a transformer in whose practice the transverse cross-sectional area at overlapping laminations at the a transformer made by the practice of the method.

SUMMARY OF THE INVENTION

In accordance with this invention, there is provided a core whose joint is formed by cutting the laminations, not at right angles to the longitudinal center line of the laminations or to any plane parallel to the laminations, but at an angle which differs appreciably from 90°, thus enabling the cut ends of the same laminations to be readily identified because they are at the same angle to the center line. Specifically, the laminations forming the core may be subdivided into stacked groups. Alternate groups may be cut biased, i.e., with the cut inclined, not perpendicular to the center line but inclined, in one direction and the intervening groups may be cut biased in the opposite direction, i.e., with the cut inclined to the center line oppositely to the cut through the alternate groups. The departure from perpendicularity may be the same in each direction. But cores whose joints are formed by cuts of the laminations of alternate groups inclined at different angles to the center line are within the scope of equivalents of this invention. In fact, the cuts through the laminations of either the alternate or the intervening groups may be at right angles to the center line and the cuts through the laminations of the other groups inclined. The cuts through the steps of each group are at the same inclination.

The laminations may be cut and the core processed to produce a transformer as disclosed in Valencic. To produce the biased cuts, the cutter 66 shown in FIG. 6 of Valencic may be set with the blades 77 and 78 at the appropriate angle to the longitudinal center line of the laminations. For the purpose of this application, the angle of inclination will be defined as the acute angle of the cut to the longitudinal center line.

It is desirable that the departure of the angle of cut from the perpendicular to the center line be small, i.e., angle of inclination to the center line should desirably be large. In practice, an angle of departure of about 3°, i.e., an angle of inclination of about 87° has been found to be satisfactory. The adoption of a large angle of departure from the perpendicular complicates the setting of the cutter and has a tendency to cause the brittle laminations to break. It has been found that with the cuts inclined at about 87° in opposite directions, the matching of the ends of the lamination which are to be joined is accomplished successfully. Practice of the teachings of this application with the cuts inclined at angles substantially different from 87° is understood to be within the scope of equivalents of this application and of any patent which may issue on or as a result thereof.

In the practice of this invention, the mismatching of the ends of the several laminations of contiguous groups is precluded by the opposite biasing of these groups. This invention also improves the potential towards mechanization of the joint reclosing by effectively separating sequential groups in the joint. But cutting first in one angled direction throughout a group, then reversing the angled direction throughout the next group and by repeating this sequence through the whole core, the "herringbone" geometry can be achieved on a wound core, i.e., an X-ray through the severed joint taken perpendicular to the surface of the web forming the laminations would have the appearance of a "herringbone" or "cross-stitched" joint.

When the core is opened to telescope the coils, the "opened" sheets are separated into oppositely cut groups and it becomes impossible to relocate odd and even groups together. Thus, the assembly problems which have occurred in the past are eliminated. If a double error occurs, the joint appears to be correctly closed, but the measured core losses increase enormously. This error also is eliminated.

BRIEF DESCRIPTION OF THE DRAWINGS

For a better understanding of this invention, both as to its organization and as to its method of operation, together with additional objects and advantages thereof, reference is made to the following description taken in connection with the accompanying drawings, in which.

DETAILED DESCRIPTION OF PRACTICE AND EMBODIMENTS OF THIS INVENTION

Figure 1:
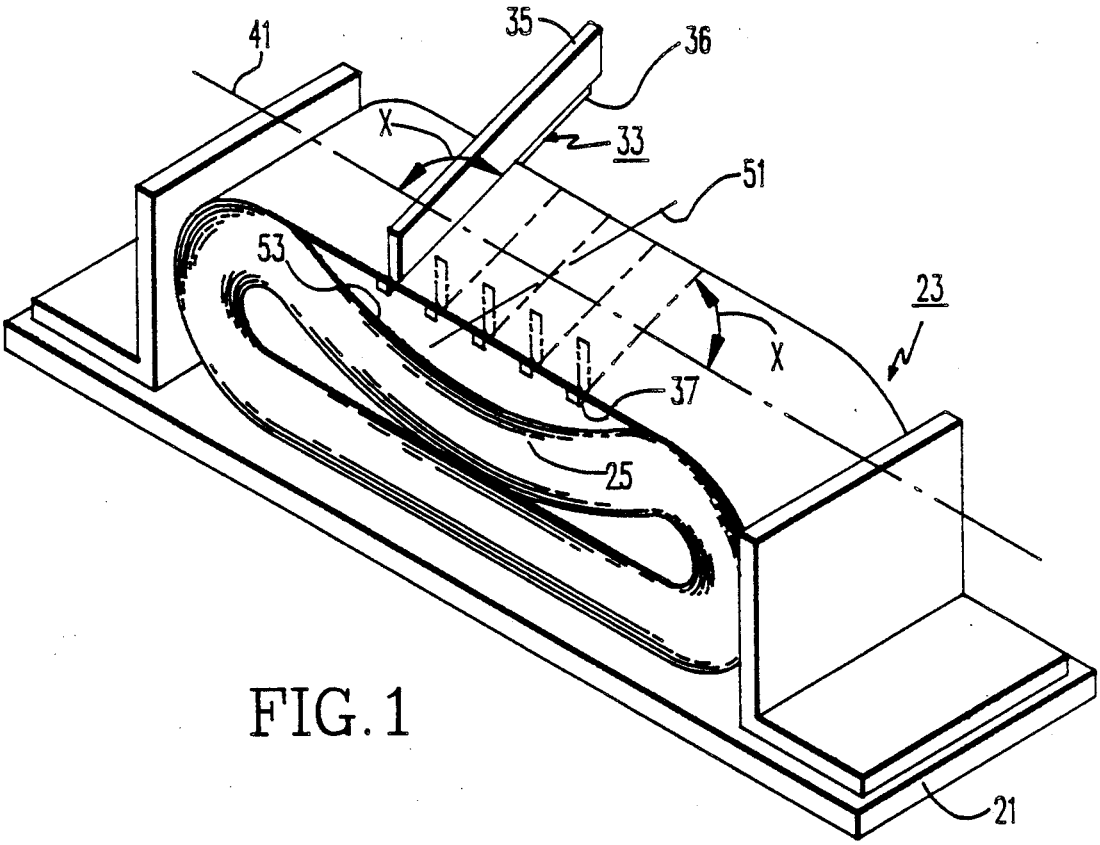
FIG. 1 is a view in isometric, generally, diagrammatic, showing apparatus for practicing this invention set to produce cuts in the laminations inclined in one direction to the longitudinal center line of the laminations.

The apparatus shown in FIGS. 1 through 9 includes a support plate 21 on which a core structure 23 is disposed. The core structure 23 is produced by winding a web 25 of amorphous metal of small thickness into a circularly annular spiral as taught by Valencic. When this spiral is disposed on plate 21 with its axis horizontal, it assumes the generally FIG. 8 configuration shown in FIGS. 1 through 6. The turns of the spiral are the laminations 27 (FIG. 9) of the core structure 23.

Figure 9:
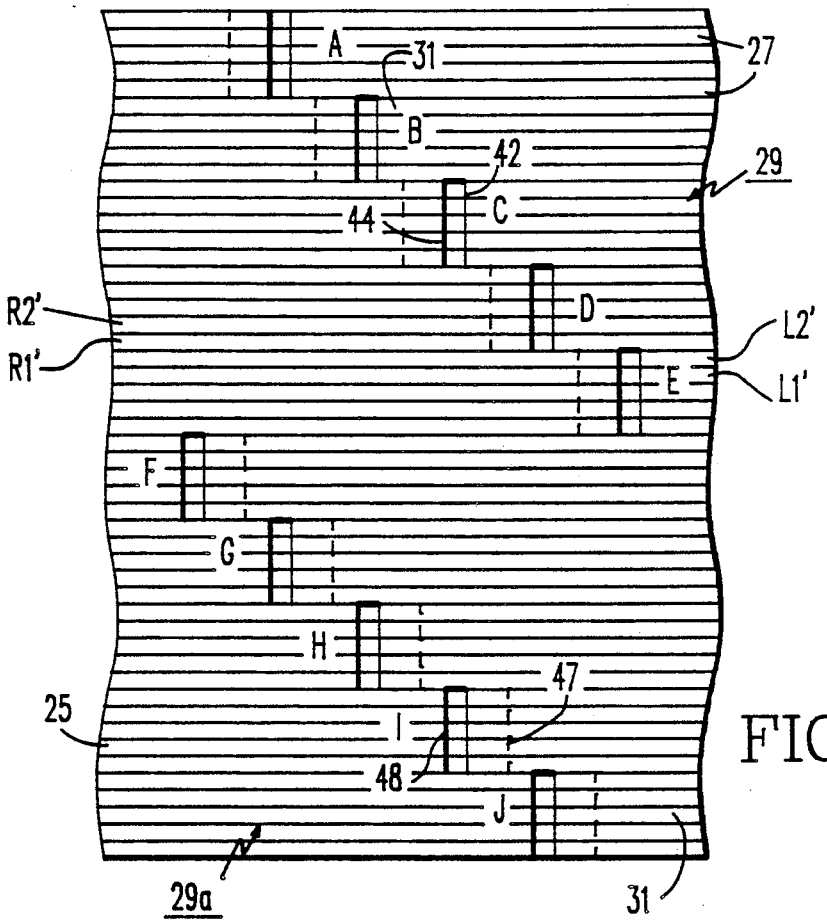
FIG. 9 is a fragmentary view greatly enlarged taken in the direction towards the edges of the lamination essentially in side elevation, showing a portion of a reassembled joint produced in the practice of this invention.

In the practice of this invention, the laminations 27 of the core structure 23 are subdivided as taught by Grimes into groups 29 and 29*a* (FIG. 9), each group being subdivided into steps 31. The steps of each group are spaced longitudinally along the core structure 23 as shown in FIG. 9. FIG. 9 shows successive groups 29 and 29*a* along the depth of the core structure. Group 29 may be taken as the topmost group and group 29*a* as the second group from the top assuming that the core structure 23 rests on plate 21 with the axis of the spiral horizontal. In FIG. 9 the steps of the top group 29 are labeled A, B, C, D and E and the steps of the group 29*a* are labeled F, G, H, I and J. In actual practice of the invention, there are a large number of groups 29 and 29*a*.

Figure 2:
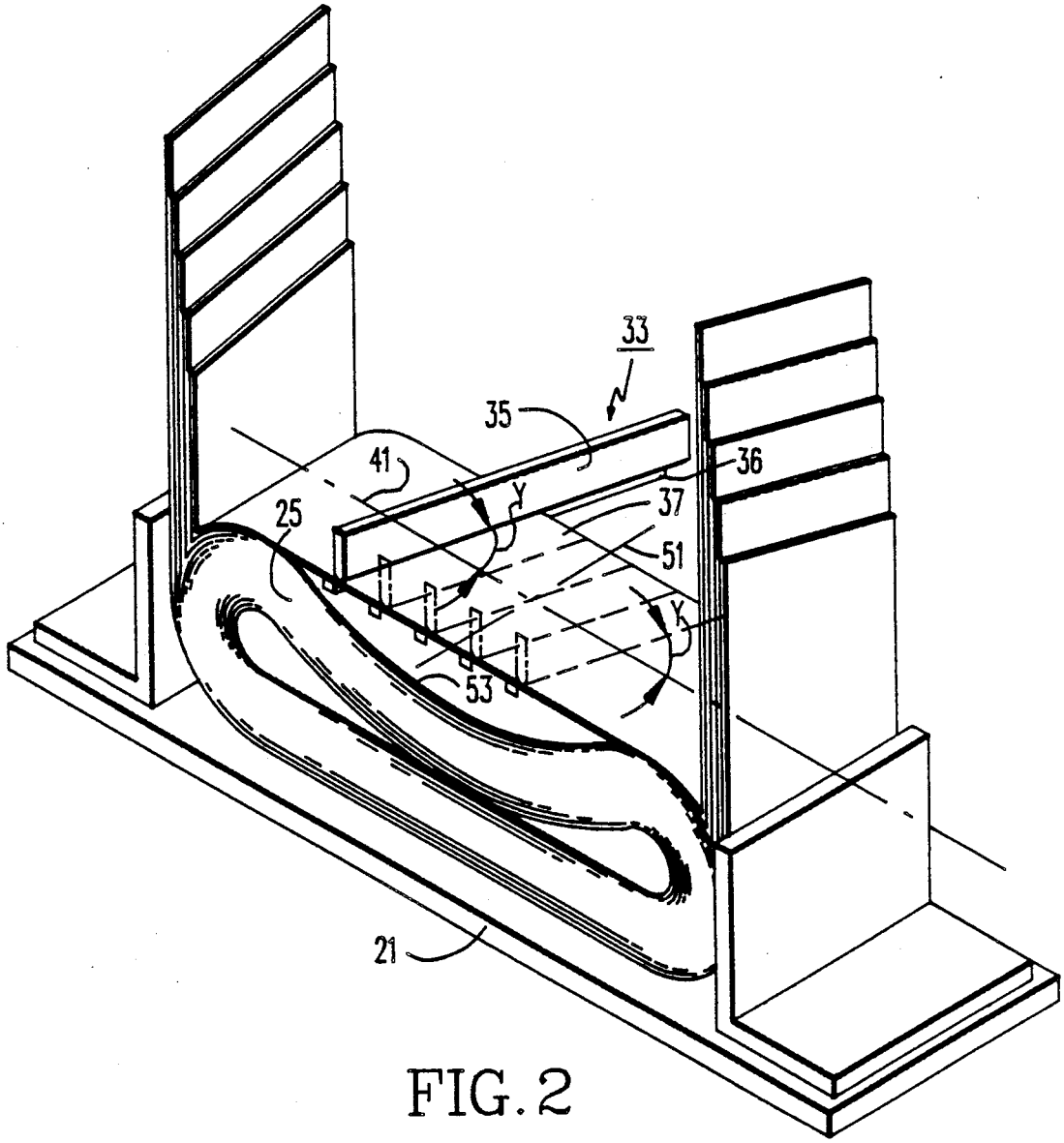
FIG. 2 is a view similar to FIG. 1 with the apparatus set to produce cuts in the laminations inclined in the opposite direction to the longitudinal center line.

As shown in FIGS. 1 and 2, the apparatus for practicing the method of this invention includes a cutter 33 having cutting blades 35 and 36. The cutter 33 is the same as is disclosed in Valencic. It is capable of producing a square cut through a predetermined number of laminations or stacks 37 and is positioned and is operable to cut the laminations. However, instead of being positioned to produce a cut of laminations at right angle to the longitudinal center line 41 of the web, the blades 35 and 36 are positioned inclined at an angle X to the center line. The center line is referred to here as a convenient reference. The blades 35 and 36 are positioned inclined at angle X to planes perpendicular to the surface of the web or to its edges where the edges are linear and parallel as shown. Specifically, the number of laminations in a stack 37 are the number in a step 31 (FIG. 9). The laminations constituting each step are raised for cutting by magnets (not shown) as disclosed in Valencic. This invention may be practiced with cutters other than that shown by Valencic.

Figure 4:
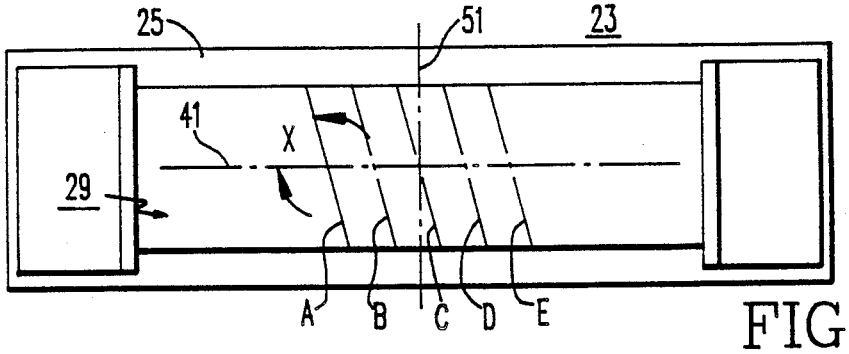
FIG. 4 is a plan view taken in the direction IV—IV of FIG. 3.
Figure 3:
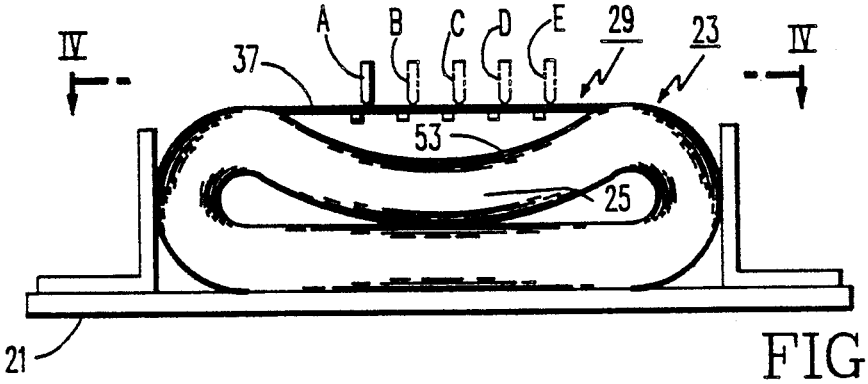
FIG. 3 is a view in side elevation generally diagrammatic of the apparatus shown in FIG. 1 for illustrating the manner in which a series of cuts of steps of the outer groups of laminations are produced in the practice of this invention.

In the practice of this invention, the cutter 33 is positioned with its blades inclined at an acute angle X to the center line 41 for cutting the steps A, B, C, D, E of the top group 29 (FIGS. 3,4). After each step is cut by the cutter, the severed lamination stacks on each side are removed by magnetic or other means and folded over the adjacent ends of the core structure 23. The cutter is then advanced to the right with reference to FIGS. 1 and 3 with its blades 35 and 36 inclined at acute angle X to the center line 41 or the support 21 is advanced to the left and the next step is raised magnetically or by other means and cut and its severed parts removed and folded back. This operation continues until all steps A, B, C, D, E of the top group are cut. The severed ends 42 and 44 of the laminations of each step are shown in FIG. 2. They are inclined acute angle X to the center line 41.

Figure 6:
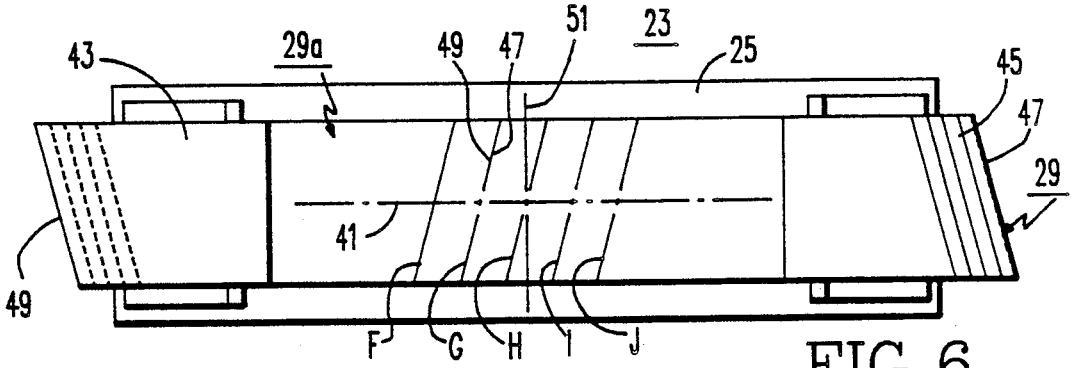
FIG. 6 is a plan view taken in the direction VI—VI of FIG. 5.
Figure 5:
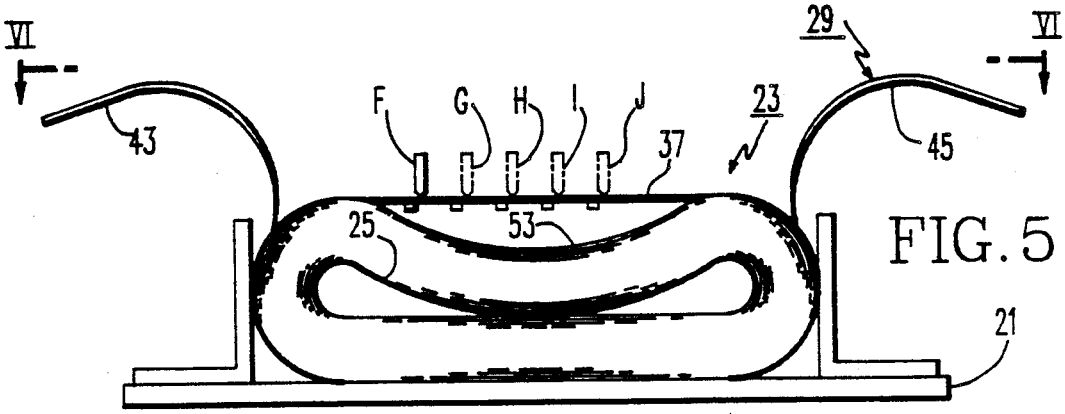
FIG. 5 is a view in side elevation similar to FIG. 3 illustrating the manner in which a series of cuts of steps of the inner group of laminations just under the outer group are made in the practice of this invention.

The core structure 23 is now in the state shown in FIGS. 5 and 6 with the severed parts 43 and 45 of the top group 29 folded away from the ends of the structure. The cutter 33 is now positioned with its blades 35 and 36 inclined at an acute angle Y (FIG. 2) to the center line 41. The inclination at angle Y may be equal and opposite to the inclination at angle X. The steps F, G, H, I, J are then cut and their severed parts folded back in succession. The severed ends 47 and 49 of the steps F through J are shown in FIG. 6. They are inclined at an angle Y to the center line 41.

It is emphasized that where the angle of inclination to the center line is large, typically 87°, it is desirable that angles X and Y be equal and opposite. The difference in inclination of the cuts in successive groups is twice the inclination for each group. The capability of recognizing a mismatch without becoming involved in the problem of cutting the steps of either of a pair of successive groups at a large angle is thus facilitated.

The cutter 33 is now repositioned with its blades 35 and 36 at angle X to the center line 41 and the steps 31 of the third group from the top are cut. Then the cutter is again repositioned with its blade at angle Y to the center line and steps of the fourth group from the top are cut. The cutting of odd-numbered groups from the top with cutter blade 35 set inclined at angle X to the center line and even-numbered groups with the cutter blade set inclined at angle Y to the center line is continued until the depth of the core structure is completely penetrated in the region of the cuts. The blades of the cutter are preferably so positioned that the cuts are spaced approximately symmetrically about the transverse center line 51 of the upper portion 53 of the core structure so that the length of the parts of the core structure 23 on each side of the cut region are approximately equal.

Once the width of the core structure 23 is penetrated, the core structure is opened at the cut-through section and the core structure is processed typically as taught by Valencic, particularly with reference to FIGS. 10 through 15 and 17 through 22 of this patent. It is understood that this invention is not confined to processing as taught by Valencic and that in the processing of core structure 23 departures from, or modifications of, Valencic's teaching as well as replacement of Valencic by entirely different teaching may be adopted without affecting the scope of this invention.

During the processing, the joint where the core structure 23 is severed is opened and reclosed twice. The first time the core is opened, mechanically manipulated and then reclosed to convert the structure into the desired shape for the stress-relief anneal. After the anneal, the structure is reopened a second time in the severed region forming the U-shaped structure 55 (FIG. 10), the coils 59 and 61 telescoped on its legs 57 and then reclosed. During the reclosing, the cut ends 42 and 44 (FIGS. 2,7) and 47 and 49 are acutted and lapped at the junctions between adjacent steps starting from the lowermost group and continuing through the uppermost group assuming the axis of the core is horizontal.

Figure 10:
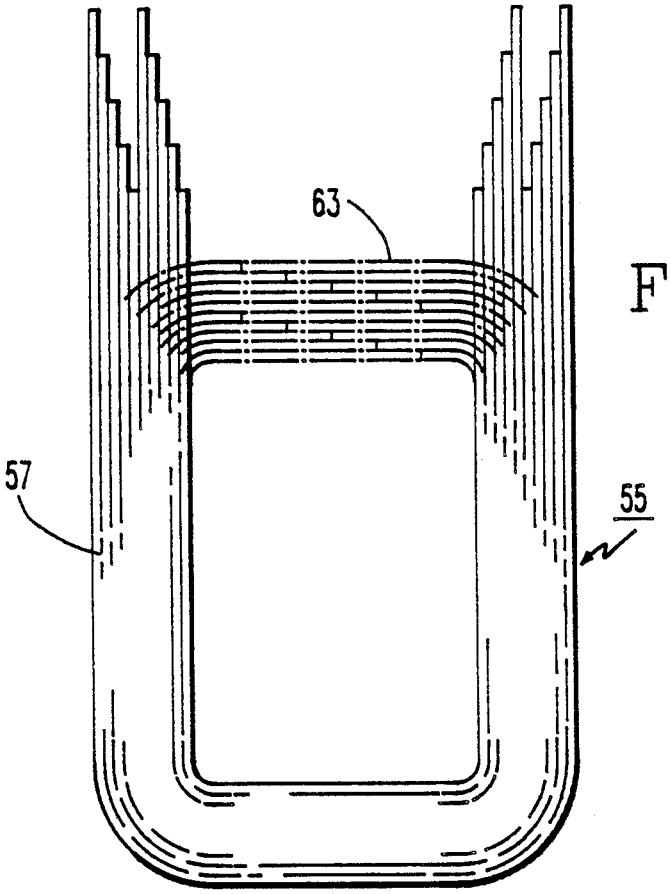
FIG. 10 is a view in side elevation of a core U-shaped structure formed in the practice of this invention for receiving the coils.
Figure 11:
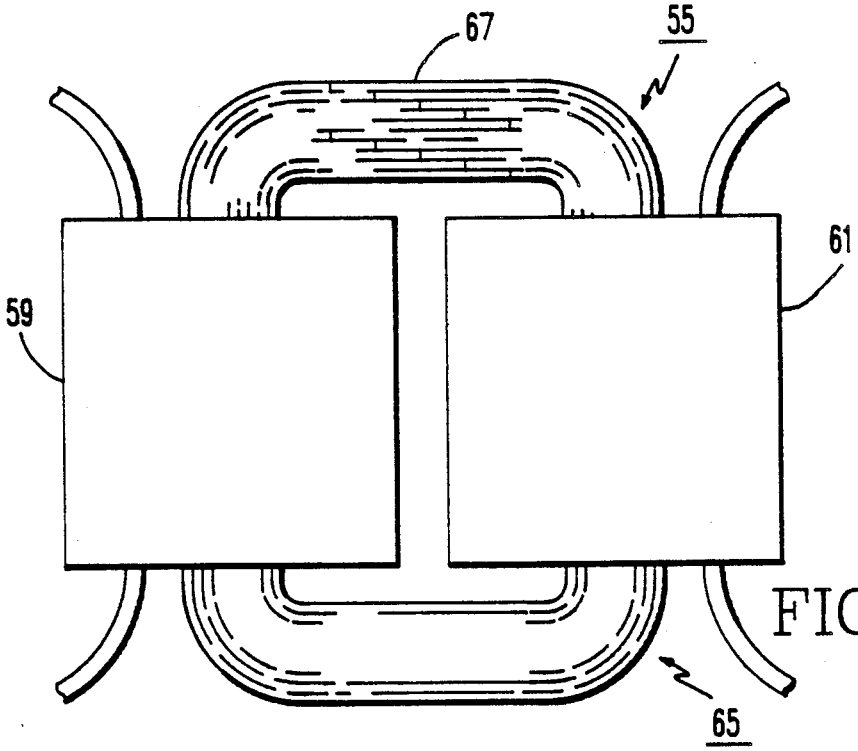
FIG. 11 is a view in side elevation of a transformer made in the practice of this invention.

During the processing, the core structure is converted into the self-supporting structure 55 shown in FIG. 10 with arms 55. While the core structure 57 is self supporting, the ends of the core structure which form the joint in the cut region 63 can be manipulated from the open position with reference to FIG. 10 to the closed position.

Figure 7:
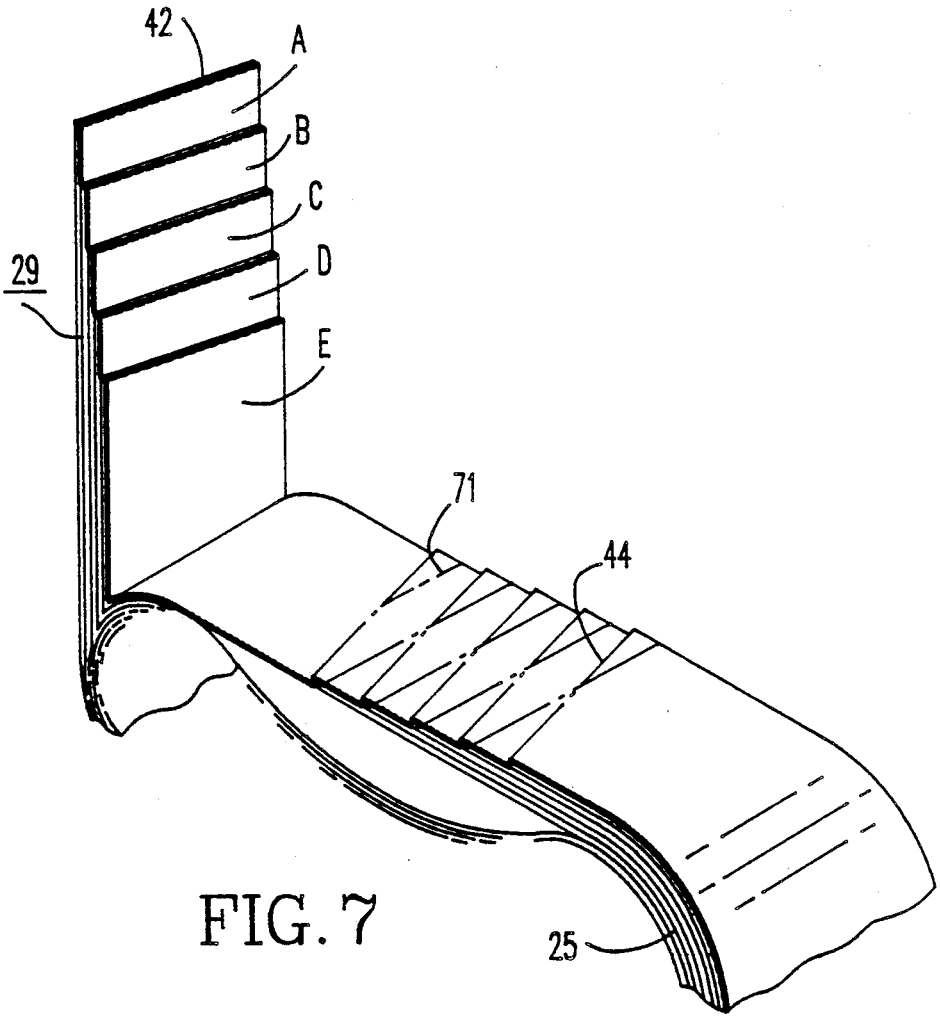
FIG. 7 is a fragmental view in isometric, generally diagrammatic, showing the manner in which the core structure is reassembled in the practice of this invention at a group of laminations cut at one inclination.
Figure 8:
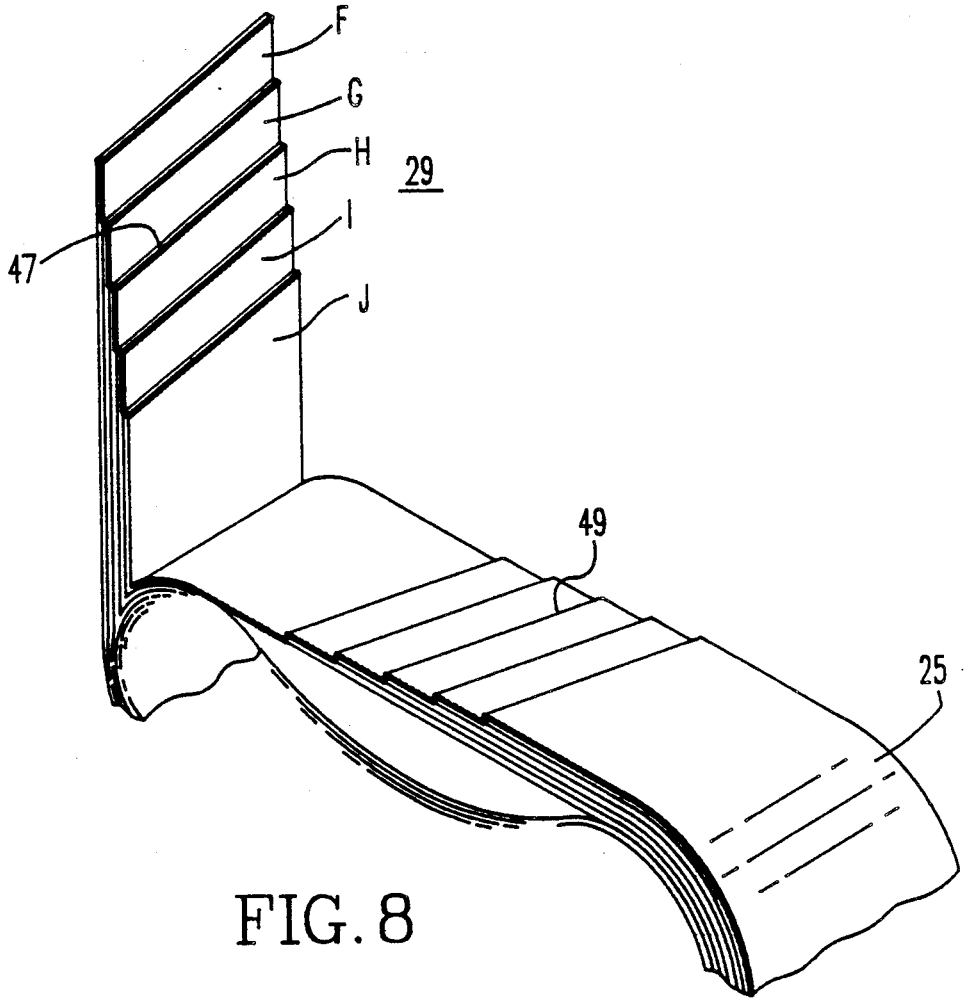
FIG. 8 is a fragmental view similar to FIG. 7 showing the manner in which the core structure is reassembled at a group of laminations cut at the opposite inclination.

It is essential, particularly during the second reclosing after the coils are telescoped on the legs that mismatching between adjacent groups be precluded and this is accomplished in the practice of this invention as shown in FIGS. 7 and 8. FIG. 7 shows the reclosing of the lamination of a group 29 such as the group made up of the steps A, B, C, D, E (FIG. 9). The inclined full lines representing ends 42 and 44 are assumed to represent the ends of steps A, B, C, D, E and not the ends of individual laminations. The steps are folded over in sequence from E to A. It is seen that the end 42 of each step is contiguous to and aligned with end 44 of the same step. FIG. 8 corresponds to the group 29 adjacent to the group represented in FIG. 7 whose steps are F, G, H, I, J. In this case, the cuts are inclined oppositely to the cut for the group of FIG. 7. In this case, the ends 47 of the steps J through F are contiguous to and aligned with the ends 49. If an attempt were made to abut the left-hand end of group 29 shown in FIG. 7 with the right-hand end of group 29*a* shown in FIG. 8, the ends 49 would be inclined as represented by the broken lines 71 in FIG. 7 and the misalignment would at once become obvious.

Prior-art practice has been confronted by the major problem that during reassembly there is a tendency for the cut laminations on one side of two groups to adhere so that the ends of the outer of two adhering groups on one side may be joined to the ends of one group on the opposite side. In the practice of this invention, the joining of two groups to one group is precluded.

Figure 11A:
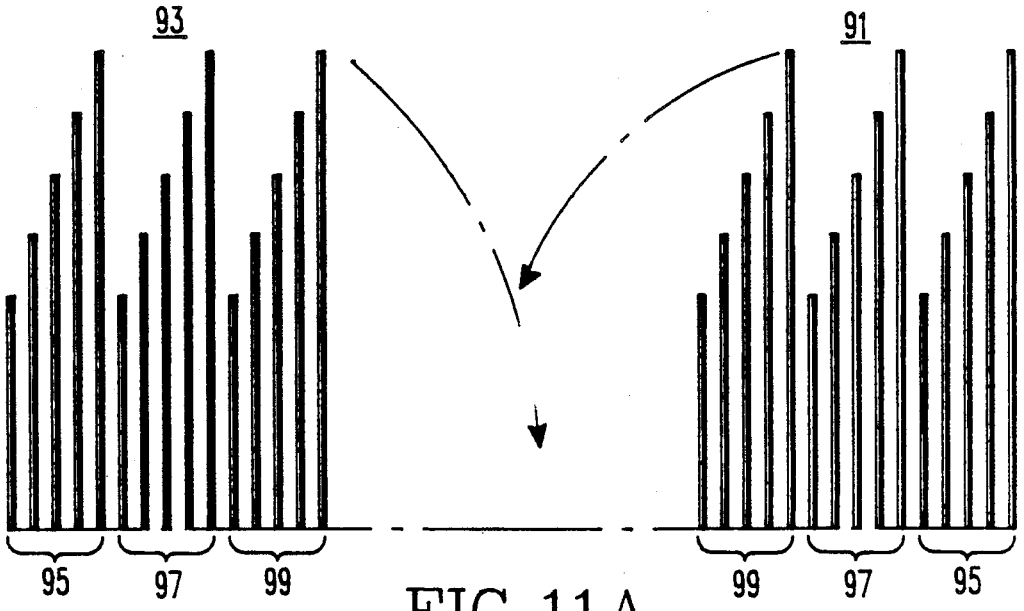
FIG. 11A is a fragmentary diagrammatic view for aiding in the explanation as to how error from sticking of laminations is precluded in the practice of this invention.

Reference is made to FIG. 11A for an understanding of this advantage. FIG. 11A shows the ends 91 and 93 of three groups 95, 97, 99 which are to be joined during reclosing. There are five steps in each group, each step being represented by a configuration having an appearance of a very narrow sheet in isometric. It is assumed that group 95 is on top and group 99 on the bottom. The cuts in group 97 are inclined oppositely to the cuts in groups 95 and 99. It has been found that the adhering occurs when the longest sheets are on top, assuming the core structure is positioned with its axis horizontal. It may be assumed that the laminations of groups 95 and 97 at the end 91 have adhered but there has been no adhesion of the laminations of groups 95 and 97 at end 93. An attempt will then be made to join group 97 of 91 to group 95 of end 93. Since the cuts in group 97 are inclined oppositely to the cuts in group 95, the mismatch by the erroneous joining of the ends of groups 95 and 97 will be precluded.

Figure 12:
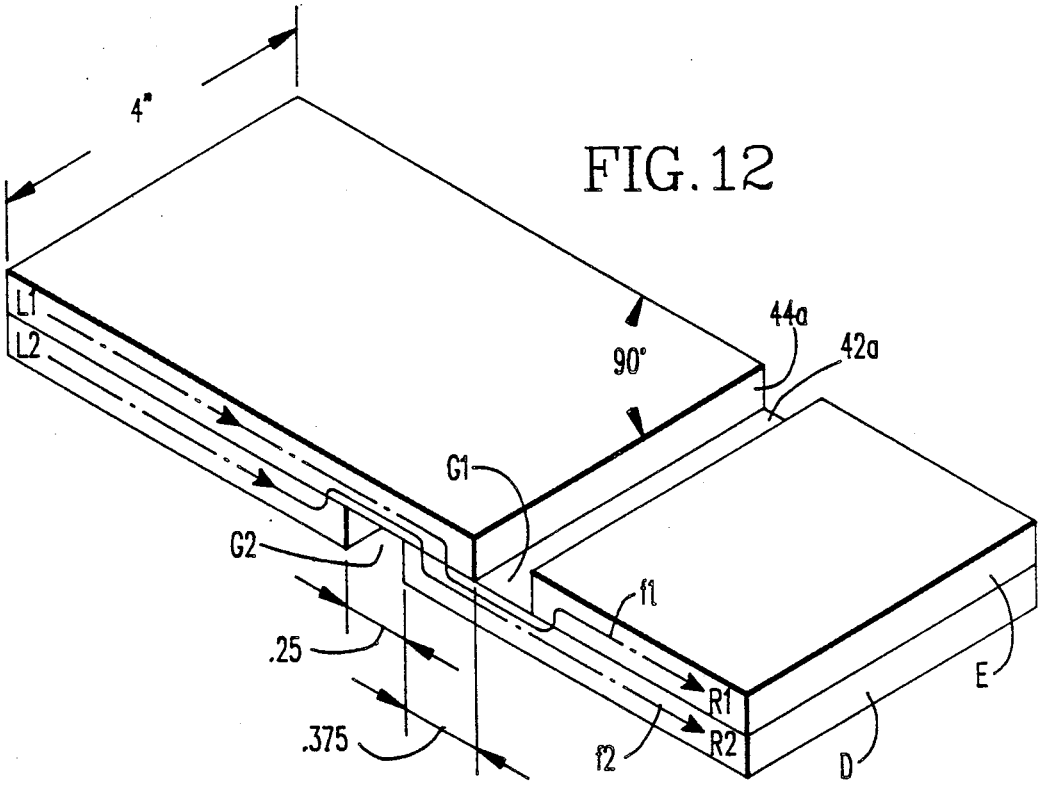
FIG. 12 is a fragmentary view in isometric, greatly enlarged and generally diagrammatic, showing the magnetic flux path in a prior-art core through the turns at the junction between steps.
Figure 13:
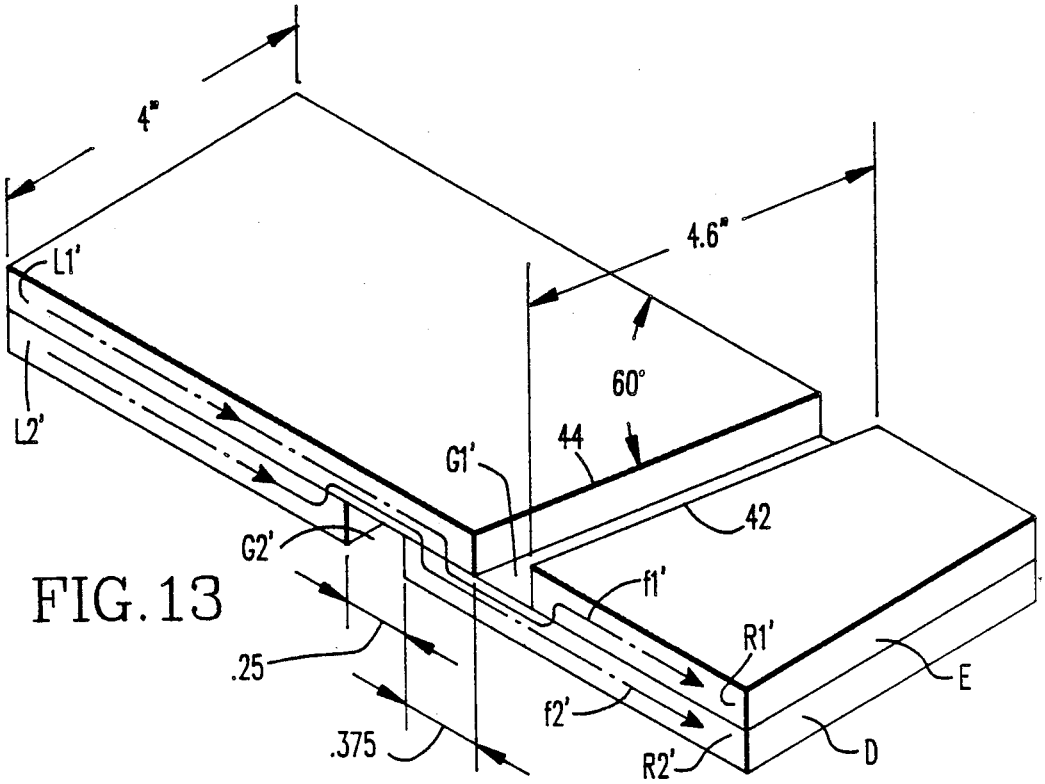
FIG. 13 is a greatly enlarged fragmentary view similar to FIG. 12 but showing the magnetic flux path in a core made in the practice of this invention.

The advantageous aspect of this invention with respect to the reduction of the crowding of the flux lines will now be explained with reference to FIGS. 12 and 13. FIG. 12 corresponds to a core structure in which the cuts 42*a*–44*a* are at right angles to the longitudinal center line as taught by prior art and FIG. 13 corresponds to a core structure in which the cuts 42–44 are inclined to the center line (FIG. 1) in accordance with this invention. In this discussion, it is assumed that the lamination or group of laminations R1 and R2 and R1' and R2' are in a core of a transformer which is in operation.

In each view, the transition lamination R1 and R2 and R1' and R2' at the junction between adjacent steps, for example between step E and step D, of group 29 are shown. The flux lines f1 and f2 are shown as flowing through R1 and R2 from L1 and L2 through the laminations R2 and R1 shown in FIG. 12 and from L1' and L2' through the laminations R2' and R1' shown in FIG. 13; in both cases from left to right. The transition laminations in FIGS. 12 and 13 are reversed with reference to FIG. 9. To aid in the understanding of the invention, dimensions are assumed; it is assumed that the width of the cut is 0.25-inch and the overlap 0.375-inch. It is also assumed that the inclination of the cut shown in FIG. 13 is at 60° to the center line.

With reference to FIG. 12, flux f1 flows through R1 until it reaches gap G1 where it flows into and through R2. It then returns to R1 when it passes gap G1. Flux f2 flows through R1 until it passes gap G2 when it flows into through R1 until it passes gap G2 when it flows back through R2. Crowding of the flux takes place in the regions in R1 at gap G2 and R2 at gap G1 where the flux flows through common channels.

One way to minimize this flux crowding and the resulting saturation and core loss increase is to spread the flux crowding over as large an area as practicable. In the prior art as shown in FIG. 12, the crowding is spread over an area of 1.0 square inch $0.25 \times 4$. Once flux f2 passes gap G2, it reenters R2 before reaching the gap G1. This reentry of flux f2 takes place over 0.375-inch. The area is $0.375 \times 4 = 1.50$ square inches. The flux crowding can be reduced by increasing the overlap. For example, for overlap of 0.5-inch, the area is 2 inches. But because of the limited area over which the transition is located, any increase in overlap would reduce the number of steps which may occur.

In the practice of this invention, the flux f2' flows from lamination R2' into lamination L1' at gap G2' and reenters laminations R2' after it passes gap G2'. Flux f1' when reaching gap G1' flows through R2'. It reenters R1' after passing gap G1'. In the practice of this invention the inclination is 60° and the cut is at 60° to the center line 41. The area above gap G2' is $0.25 \times 4.6$ or 1.15 square inches. The area over which flux f2' reenters R2' is $0.375 \times 4.6 = 1.73$ square inches. The increase in area in each case is produced without reducing the number of steps within the region. The smaller the inclination of the cut to the center line, the greater the area over which the crowding is spread.

While preferred embodiments and preferred practice of this invention have been disclosed herein, many modifications thereof are feasible. This invention is not to be restricted except insofar as is necessitated by the spirit of the prior art.

We claim.

1. The method of making a transformer having a core and coil means whose turns are wound into an integrated coil structure having an opening therein for telescoping onto said core, said core being formed of a web of magnetic metal of small thickness; the said method including:

(a) winding said web into a generally spiral core structure having a plurality of superimposed laminations about a window;

(b) subdividing said laminations of said core structure into groups, said groups being stacked to form said core structure;

(c) producing first cuts through the laminations of each of alternate groups in said core structures, each said cut in the laminations of said alternate groups along said core structure being inclined to the center line of said web in one direction at an angle appreciably different from 90°;

(d) producing second cuts through the laminations of each of the groups along said core structure intervening between alternate groups, each of said second cuts in the laminations of said intervening groups along said core structure being inclined to the center line of said web in a direction opposite to said one direction at an angle appreciably different from 90°;

(e) separating said laminations at said cuts and converting said core structure into a generally U-shaped structure whose arms terminate in said cuts;

(f) telescoping said coil structure in the arms of said U-shaped structure; and (g) guided by the difference between the inclination of the severed ends of the laminations, rejoining the ends of the laminations of said groups, group by group, by folding the portions of the laminations extending from each said cut into position in which said cut ends of said laminations of said each group are aligned thus abutting the ends of the lamination of each group only to the opposite ends of the lamination of the same group from which said first-named ends were severed, precluding the joining of the ends of the laminations of one group to the ends of the laminations of adjacent groups.

2. The method of claim 1 wherein the angles of inclination of the first cuts and the second cuts are substantially equal and opposite and depart from 90° to the center line of the web by a small magnitude.

3. The method of making a transformer having a core and coil means whose turns are wound into an integrated coil structure having an opening therein for telescoping onto said core, said core being formed of a web of magnetic metal of small thickness, the said method including:

(a) winding said web into a generally spiral core structure having a plurality of superimposed laminations about a window;

(b) subdividing the laminations of said core structure into groups, said groups being stacked to form said core structure;

(c) producing first cuts through the laminations of each of alternate groups in said core structure, each said cut in the laminations of alternate groups along said core structure being inclined to the center line of said web in one direction at an angle appreciably different from 90°;

(d) producing second cuts through the laminations of each of the remaining groups along said core structure, each of said second cuts being at a different angle to the longitudinal center line of said web than said first cuts;

(e) separating said laminations at said cuts and converting said core structure into a generally U-shaped structure whose arms terminate in said cuts;

(f) telescoping said coil structure on the arms of said U-shaped structure; and (g) guided by the difference in the angle to the longitudinal center line of the web of the first cuts and the second cuts rejoining the ends of the laminations of said groups, group by group, by folding the portions of the laminations extending from each said cut into position in which said cut ends of said laminations of said each group are aligned thus abutting substantially the ends of the lamination of each group only to the opposite ends of the lamination of the same group from which said first-named ends were severed, precluding the joining of the ends of the laminations of one group to the ends of the lamination of other groups.

4. The method of claim 3 including subdividing each group into steps displaced longitudinally from each other along the web and producing first and second cuts each of which comprises cuts in the steps of each group displaced longitudinally along the web but at the first angle to the longitudinal center line of the web for the alternate groups and at the second angle to the longitudinal center line of web for the remaining groups.

5. The method of claim 3 wherein the web of magnetic metal is composed of a material which is freely bendable.

6. The method of making a transformer with reduced losses, the said method including;

(a) winding a web of magnetic metal into a spiral structure having a window in the center;

(b) subdividing the turns of said spiral into groups, each group being subdivided into steps;

(c) producing a series of cuts through the steps of each group in a region of said spiral, the cuts through the steps of each group being spaced longitudinally along said web in a predetermined direction; the cuts for each step of a group and the cut of the succeeding step terminating such that the last turn of a step of a group and the first turn of said succeeding step of said group overlap, whereby magnetic flux flowing through said last turn and through said first turn will be conducted together through one and the other of said last and first turns in the region of said cuts, producing crowding of the flux in said region, the said cuts being produced through all groups of said web;

(d) opening said spiral at said cuts;

(e) thereafter converting said spiral into a U-shaped structure;

(f) telescoping coils on the arms of said U-shaped structure; and (g) reclosing said groups in the region of said cuts, thus producing a transformer having the reclosed spiral structure as a core;

the said method being characterized by that the cuts through the steps are inclined to said longitudinal center line at an angle appreciably different from 90°, whereby the area of the core in the region of said crowding of said flux is increased.

7. The method of telescoping the integral coils on a transformer core structure formed of a spiral wound web of freely bendable, magnetic material of small thickness whose turns constitute laminations of the core, the said method comprising: severing successive groups of laminations throughout the core structure in a region of the core structure, the laminations of alternate groups being severed at a first angle different from 90° to the centerline of the web and the laminations of the remainder of the groups being severed at a second angle different from the first angle, opening the core structure by separating the laminations bounding the severed ends in said region and converting the core structure into a generally U-shaped structure, telescoping said coils on the arms of said U, and reclosing the core structure by folding the portions of the laminations extending from each said cut into position in which said cut ends of said laminations of said each group are aligned thus abutting the severed ends of the laminations of the same groups relying on the difference in the angle of severing of the alternate groups of laminations and the remainder of the groups of laminations to match the severed ends of the same groups with each other.

* * * * *